United States Patent [19]

Ajemian

[11] Patent Number: 4,618,281

[45] Date of Patent: Oct. 21, 1986

[54] RAISED PAVEMENT MARKER BRACE

[76] Inventor: Van R. Ajemian, 331 N. Vail Ave., Montebello, Calif. 90640

[21] Appl. No.: 688,066

[22] Filed: Dec. 31, 1984

[51] Int. Cl.[4] ..... E01F 9/01

[52] U.S. Cl. ..... 404/16; 116/63 R

[58] Field of Search ..... 404/6, 9, 12, 14, 15, 404/16, 22-24; 116/63 R; D10/113; 340/114 R, 116; 248/205.3, 500

[56] References Cited

U.S. PATENT DOCUMENTS

| | | | |
|---|---|---|---|
| D. 220,138 | 3/1971 | Hedgewick | D10/113 |
| D. 220,553 | 4/1971 | Hedgewick | D10/113 |
| D. 220,554 | 4/1971 | Hedgewick | D10/113 |
| 1,839,276 | 1/1932 | Taylor | 340/116 |
| 3,332,327 | 7/1967 | Heenan | 404/16 |
| 3,427,933 | 2/1969 | Taylor Myers | 404/9 |
| 3,575,092 | 4/1971 | Freeman | 404/10 |
| 3,758,191 | 9/1973 | Hedgewick | 404/16 X |
| 3,784,279 | 1/1974 | Hedgewick | 404/12 |
| 3,867,013 | 2/1975 | Ashenfarb | 404/13 X |
| 3,971,623 | 7/1976 | Hedgewick et al. | 404/12 X |
| 3,975,108 | 8/1976 | Suhr et al. | 404/16 |
| 4,237,191 | 12/1980 | Horne | 404/16 X |

FOREIGN PATENT DOCUMENTS

| | | | |
|---|---|---|---|
| 1163751 | 10/1969 | United Kingdom | 116/63 R |

*Primary Examiner*—Stephen J. Novosad
*Assistant Examiner*—John F. Letchford
*Attorney, Agent, or Firm*—Rupert Brady, Jr.

[57] ABSTRACT

A raised pavement marker brace for extension about a raised pavement marker having an upper and side surfaces, comprises a base portion configurated to extend about the marker and to engage the surface of the pavement for securement by adhesive, the wall portion extending upwardly from the base portion to protect at least one side of the marker, and a retaining lip portion extending upwardly from the wall portion and extending over a portion of said upper marker surface. A top portion of the brace may extend over at least a portion of the upper surface of the marker to protect the surface. The brace may extend over a portion of the marker side surface and define an opening about a reflective portion of the marker side surface. The base portion may preferably define a plurality of openings for the extension therethrough of the adhesive during application of the adhesive, thus to provide adhesive portions extending from said openings onto the upper surface of the base portion to provide improved securement of the base portion to the pavement. The adhesive may preferably extend beyond the periphery of the base portion and upwardly from the pavement about a portion of the brace base portion for improved securement against movement of the brace. The brace and the marker preferably define sufficient space between them for the extension upwardly into the space of a ridge of adhesive for improved retention of the brace against movement relative to the pavement.

8 Claims, 15 Drawing Figures

RAISED PAVEMENT MARKER BRACE

FIELD OF INVENTION

The present invention relates to raised pavement markers, and, specifically, to a brace which will prolong the usefulness of said markers.

DISCUSSION OF THE PRIOR ART

Raised pavement markers are used as a safety measure on roadways, and sometimes the markers serve simply as lane or automobile stall dividers. There are two types of markers, nonreflective and reflective. Several designs and compositions for markers have been patented within the art, and are relevant to the present invention:

U.S. Pat. No. 3,332,327—S. A. Heenan July 25, 1967

U.S. Pat. No. 3,575,092—Clarence S. Freeman Apr. 13, 1971

U.S. Pat. No. 3,867,013—Sidney Ashenfarb Feb. 18, 1975

U.S. Pat. No. 4,237,191—John M. Horne Dec. 2, 1980

Nonreflective markers and reflective markers in use are either of a curvilinear configuration or of a generally rectangular configuration.

Markers in California are secured to the pavement, whether concrete or asphalt, by applying adhesive to the underside of the markers and then pressing the markers against the pavement, causing the adhesive to spread and coat the entire underside of the markers.

Although the adhesive is strong the markers suffer from one of two problems: either the markers begin fragmenting, with fragments detaching from the adhesive and being thrown onto other parts of the roadway, until the markers have disintegrated beyond usefulness, or the markers wholly detach from the adhesive and are thrown onto other parts of the roadway. Thrown marker fragments can be dangerous, especially to substantially unshielded motorcyclists.

Markers with a plastic shell do not succumb to fragmentation as easily as do markers of ceramic composition, but the former does succumb more easily to wearing away from contact with tires and the weather.

Because of these problems, less than one hundred percent of the markers are left in a useful condition after a given time. Replacement becomes necessary for the failed markers, which, aside from the cost, requires that workers return to the roadways to secure new markers, a hazardous job in some instances. Also, since replacement can occur only at given time intervals, there is less than the full complement of markers on roadways most of the time. Since the markers serve a safety function in most instances, this means that optimal safety is not available except for a brief period of time following replacement.

These problems can be addressed by improved designs or compositions of markers. Alternatively, these problems can be addressed without making any changes in the markers now in use.

OBJECTS OF THE PRESENT INVENTION

It is the primary object of the present invention to prolong significantly the usefulness of raised pavement markers, whether on concrete or on asphalt roadways, whether epoxy or some other adhesive is being used, whether the markers are nonreflective or reflective, whatever the configurations and compositions of the markers.

A corollary object is to save cost by prolonging the usefulness of markers beyond th cost of adding the present invention.

A second corollary object is to require the presence of workers on roadways less often, thereby enhancing their personal safety.

A third corollary object is the increase in driver safety on roadways because a larger number of markers will be useful after a given time than if the present invention were not utilized.

Yet another object is the reduction in the number of incidents of detachment and throwing of marker fragments, which might hurt unshielded drivers or damage vehicles.

Another object of the present invention is the ability to utilize the same with markers being secured to pavement or with markers which had been secured at a previous time.

An additional object is the ability to fabricate the present invention independently or with markers in a unitary assembly.

Yet another object is to allow for easy, quick and inexpensive securement of the present invention to pavement or to markers.

Another object of the present invention is to take advantage of both the cohesive and adhesive qualities of the adhesive.

Other objects may become apparent from a consideration of the drawings and the following description thereof.

DRAWINGS

DESCRIPTION OF THE PRESENT INVENTION

Figure 1:
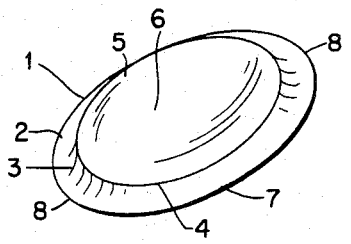
FIG. 1 is a perspective view of the present invention, in a basic embodiment, as configured and adapted to extend about a nonreflective marker of curvilinear configuration.

Referring to FIG. 1, we see Raised Pavement Marker Brace 1, comprising base portion 2, wall portion 3 and retaining lip portion 4. The exposed upper surface 6 of a nonreflective marker 5 of curvilinear configuration is shown. Base portion periphery 7 of Brace 1 is also shown.

Figure 2:
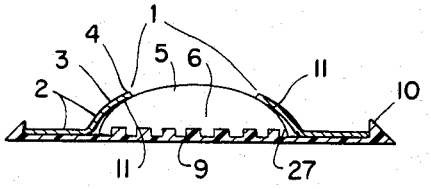
FIG. 2 is a cutaway side view of the portion indicated by section lines 8—8 in FIG. 1, with the adhesive added.

Referring to FIG. 2, a cutaway side view of Brace 1 and of marker 5 along section lines 8—8 is shown. Base 2, wall 3, lip 4, periphery 7, and surface 6 are shown. Adhesive 9 and adhesive ridge 10 are also indicated, as is unitary assembly area 11, and side surface 27 of Brace 1.

Figure 3:
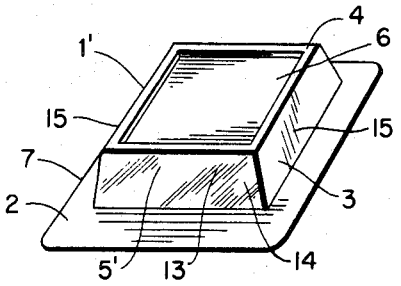
FIG. 3 is a perspective view of the present invention, in basic embodiment, as configured and adapted to extend about a reflective marker of generally rectangular configuration.

With reference to FIG. 3, we see Raised Pavment Marker Brace 1', comprising base 2, wall 3, lip 4, and periphery 7. The reflective portion 13 of a reflective marker 5' of generally rectangular configuration is exposed at opening 14 in Brace 1'.

Figure 4:
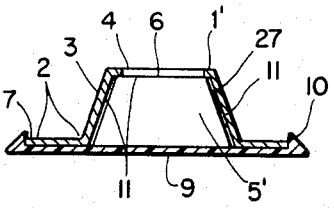
FIG. 4 is a cutaway side view of the portion indicated by section lines 15—15 in FIG. 3, with the adhesive added.

With reference to FIG. 4, a cutaway side view of Brace 1' and of marker 5' along section lines 15—15 is shown. Base 2, wall 3, periphery 7, and lip 4 of Brace 1' are indicated, as are surface 6 and surface 27 of marker 5'. Adhesive 9, ridge 10, and area 11 are also shown.

Figure 5:
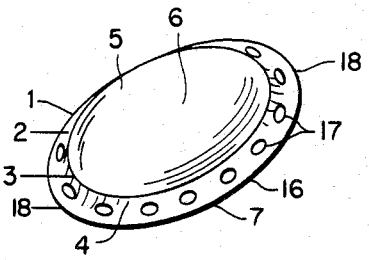
FIG. 5 is a perspective view of the present invention, in preferred embodiment, as configured and adapted to extend about a nonreflective marker of curvilinear configuration.

Referring to FIG. 5, we see Brace 1, which has added thereto uneven underside 16 and openings 17, and marker 5.

Figure 6:
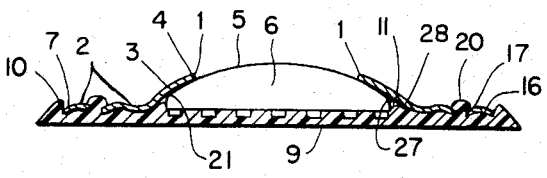
FIG. 6 is a cutaway side view of the portion indicated by section lines 18—18 in FIG. 5, with the adhesive added.

Referring to FIG. 6, a cutaway side view of Brace 1 and of marker 5 along section lines 18—18 is shown. Underside 16, an opening 17 and space 21 are indicated, as are adhesive portion 20 and adhesive ridge 28.

Figure 7:
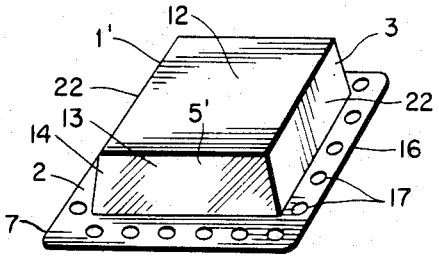
FIG. 7 is a perspective view of the present invention, in preferred embodiment, as configured and adapted to extend about a reflective marker of generally rectangular configuration.

With reference to FIG. 7, we see Brace 1', which has added thereto underside 16 and openings 17, and marker 5'.

Figure 8:
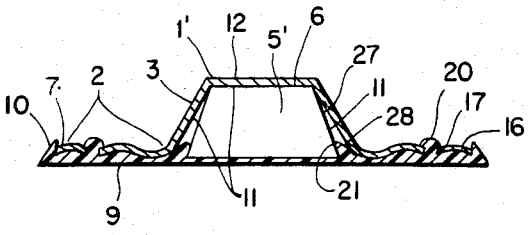
FIG. 8 is a cutaway side view of the portion indicated by section lines 22—22 in FIG. 7, with the adhesive added.

With reference to FIG. 8, a cutaway side view of Brace 1' and of marker 5' along section lines 22—22 is shown. Underside 16, an opening 17 and space 21 are indicated, as are adhesive portion 20 and ridge 28.

Figure 9:
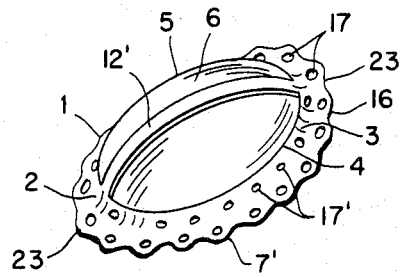
FIG. 9 is a perspective view of the present invention, showing additional variations contemplated as within the scope of the present invention, as configured and adapted to extend about a nonreflective marker of curvilinear configuration.

Referring to FIG. 9, we see Brace 1 and marker 5. Brace 1 differs from the preferred embodiment in that the former has top 12', periphery 7' and openings 17'.

Referring to figure ten, a cutaway side view of Brace 1 and of marker 5 along section lines 23—23 is shown. Top 12', periphery 7', an opening 17' and adhesive portion 20' are in addition to those features shown in the cutaway side view of the preferred embodiment.

Figure 11:
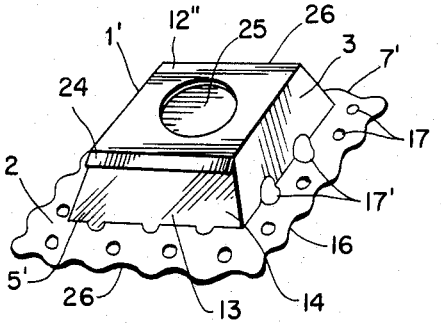
FIG. 11 is a perspective view of the present invention, showing additional variations contemplated as within the scope of the present invention, as configured and adapted to extend about a reflective marker of generally rectangular configuration.

Referring to FIG. 11, we see Brace 1', which has added thereto top 12", declined eve 24, hole 25, periphery 7' and openings 17', differing from the preferred embodiment, and marker 5'.

Figure 12:
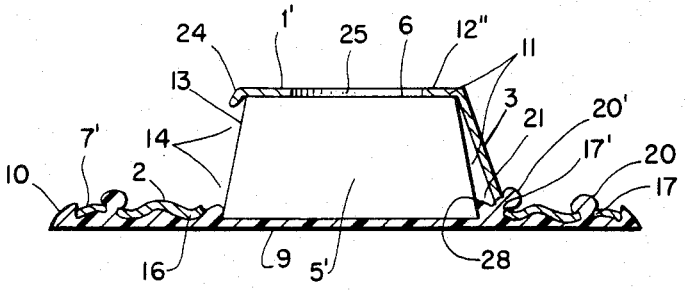
FIG. 12 is a cutaway side view of the portion indicated by section lines 26—26 in FIG. 11, with the adhesive added.

Referring to FIG. 12, a cutaway side view of Brace 1' and of marker 5' along section lines 26—26 is shown. In addition to those features shown in the cutaway side view of the preferred embodiment, we see top 12", hole 25, periphery 7', openings 17' and adhesive portion 20', and marker 5'.

Figure 13:
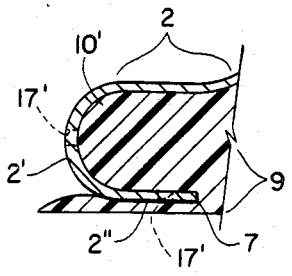
FIG. 13 is an enlarged detail of a portion of either FIG. 2 or FIG. 4, with a heretofore unmentioned variation contemplated as within the scope of the present invention.
Figure 10:
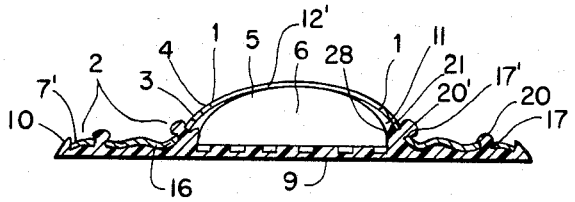
FIG. 10 is a cutaway side view of the portion indicated by section lines 23—23 in FIG. 9, with the adhesive added.

Referring to FIG. 13, we see a variation of base 2, showing base 2, base 2' and base 2", as well as new locations for openings 17'. The effect of this base 2 variation upon ridge 10 is indicated by adhesive portion 10'.

Figure 14:
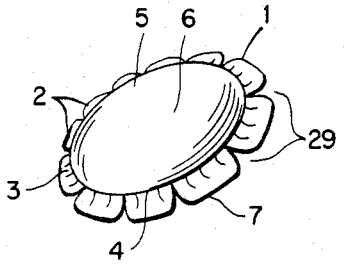
FIG. 14 is a perspective view of the present invention, in basic embodiment with one variation, as configured and adapted to extend about a nonreflective marker of curvilinear configuration.

With reference to FIG. 14, we see the basic embodiment of Brace 1 with marker 5, showing incisions 29 in base 2.

Figure 15:
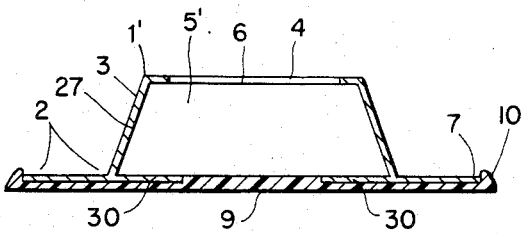
FIG. 15 is a cutaway side view of the portion indicated by section lines 15—15 in FIG. 3, with one variation, and with adhesive added.

With reference to FIG. 15, we see the basic embodiment of Brace 1' with marker 5', showing inward elongation 30 in base 2.

OPERATION OF THE PRESENT INVENTION

The Raised Pavement Marker Brace can be configured and adapted for extension about any raised pavement marker, whether the marker be nonreflective and curvilinear, nonreflective and generally rectangular, reflective and curvilinear or reflective and generally rectangular. It is also within the scope of the present invention to be configured and adapted for extension about markers, the geometries of which are neither curvilinear nor generally rectangular. The drawings accompanying this application show the present invention being utilized with markers currently in use, but this should not be construed as a limitation on the present invention.

The Brace can be composed of one or more metals, one or more metallic alloys and/or one or more nonmetals, as, for example, polyester. The greater the strength of the composition, the less thick the Brace can be, although a thickness of less than 0.05" may offer little advantage to markers.

The Brace takes better advantage of the adhesive and the cohesive qualities of the adhesive used to secure the markers, in order to enhance retention of the Brace against movement relative to the pavement, and, therethrough, to prolong the usefulness of the marker upon or around which the Brace sits.

A raised pavement marker with adhesive on its underside is secured to pavement by a worker or a machine. The adhesive extends outward from the marker underside. A Brace is then extended about the marker, whereupon the Brace is secured by the extended adhesive to the pavement, as is shown in FIGS. 2, 4, 6, 8, 10 and 12.

Referring back to FIGS. 1 through 4, we see that enhanced retention of the Brace is enabled by securement of base 2 of the Brace to adhesive 9 and by the upward extension of ridge 10 about the periphery 7, this latter occasioned by pressing the Brace downward upon securement. Ridge 10 takes advantage of the adhesive's cohesive property: should adhesion of the Brace to the adhesive fail, the cohesive strength of the adhesive will aid to retain the Brace with respect to horizontal force applied to the Brace.

Many Brace features in FIGS. 5 through 13 show means by which to take advantage of the adhesive and cohesive properties of the adhesive. Openings 17 and 17′ allow adhesive 9 to extend upward through said openings until adhesive portions 20 and 20′, respectively, are created upon the upper surface of base 2. Adhesive portions 20 and 20′ enhance securement of the Brace. Openings 17 and 17′ can vary in number, shape, size and position, all of which are contemplated as within the scope of the present invention.

Space 21 in FIGS. 6, 8, 10 and 12, enabled by constructing Brace wall 3 so that said wall does not extend snugly about side surface 27 of the marker, allows adhesive ridge 28 to extend upward between the Brace and the marker. Ridge 28, like ridge 10, takes advantage of adhesive 9's cohesive property, and, additionally, of adhesive 9's adhesive property, this latter by coming in contact with surface 27 and the inside of wall 3.

Underside 16 increases the contact area between base 2 and adhesive 9. Underside 16 accomplishes this by one or more of a number of means which can increase the lower-surface area of base 2: dents, furrows, serrations, denticles, grooves, among others. Underside 16 takes advantage of the adhesive and the cohesive properties of the adhesive.

Periphery 7′, shown as undulating, also can be serrations, a multitude of tabs or any design which will increase contact area between said periphery and adhesive 9, thereby improving retention of the Brace against horizontal force.

FIG. 13 reveals an additional feature within the scope of the present invention. Base 2 can be configured so that periphery 7 lies underneath. Ridge 10 becomes adhesive portion 10′, which takes advantage of the adhesive property of the adhesive, in addition to the cohesive one. Even better securement is enabled by the extension of adhesive 9 through openings 17′. Base 2's configuration protects a portion of adhesive 9 against the weather and damage from vehicles. Furthermore, this configuration retains the Brace with respect to either horizontal or vertical force applied to the Brace.

FIG. 14 reveals segmented base 2, with incisions 29 to allow at least one segment to be bent inward, under the marker. This may help to retain the Brace. Although this feature can be used with either curvilinear or generally rectangular markers, or with markers of other geometric configurations, the bending inward of at least one segment would have to occur before the marker is secured to the pavement.

FIG. 15 reveals elongation 30, an extension inward of base 2. This feature can be used with a marker of any geometric configuration, but means need be anticipated to enable the Brace to sit upon or around the marker. For example, with respect to a curvilinear marker, elongation 30 cannot exceed an arc of 180° along base 2, and, with respect to a generally rectangular marker, base 2 would have to be removed adjacent to at least one wall 3 or reflective portion 13.

For fabrication of the Brace and a marker into a unitary assembly, FIGS. 2, 4, 6, 8, 10 and 12 show that Brace and marker can be assembled at areas 11 with adhesive. Alternatively, the Brace can be integrated into the marker during fabrication of the latter. FIGS. 14 and 15 reveal yet another means for unitary assembly.

Brace features other than those heretofore revealed act to protect the marker: basic to all embodiments are wall 3 and lip 4. Tops 12, 12′ and 12″ are simply variations of lip 4. Top 12 or 12′ or 12″ is useful for markers with plastic shells, because said shells wear from contact with vehicle tires. One of these tops can be used with ceramic markers, to reduce or prevent fragmenting, but the glazed white or yellow surface 6 of ceramic markers is preferably exposed. Top 12′ and top 12″, with hole 25, show two of many contemplated variations of top 12 within the scope of the present invention. Top 12′ or top 12″ may be preferable because less material is needed for their construction, thereby reducing weight and cost.

A further variation to top 12 is declined eve 24, in FIGS. 11 and 12. Eve 24 is used to reduce the intensity or frequency of vehicle tires scuffing reflective portion 13, because scuffing degrades the reflective quality.

While the above desciptions contain many specificities, these should not be construed as limitations on the scope of the present invention. Many variations, aside from those mentioned above, are possible and are contemplated as within the scope of the present invention.

For example, the Brace, as in FIGS. 1 through 13, can be extended about a marker even if the marker had been secured to pavement at a previous time.

The Brace can be configured and adapted to extend about "double" markers, two markers secured right next to one another.

Additionally, openings 17 and 17′ can resemble the grates of a vegetable grater, "scooping" adhesive 9 so as to take advantage of the adhesive and the cohesive qualities of the adhesive.

A worker using a putty knife can smooth adhesive portions 20 and 20′ and adhesive ridge 10 so as to better cover the upper surface of base 2 and the upper surface of the periphery, respectively.

Openings 17 allow actual rivets and nails to be used, and this may be of advantage to secure Braces and markers on asphalt roadways, because a problem at times with markers secured to asphalt is that whole markers, adhesive and underlying asphalt are torn loose together.

The many variations/additions revealed in FIGS. 5 through 15 and discussed immediately above can be added to the basic Brace embodiments singly or in any combination, and are not limited by what is shown in FIGS. 5 through 15 or discussed immediately above.

Accordingly, the scope of the present invention and the definitions of the terms employed in the claims should be determined with all possible permutations in mind.

The inventor claims:

1. A raised pavement marker brace configured and adapted to extend about a wholly stationary raised pavement marker having an uppermost surface and at least one side surface, said brace inseparably comprising a retaining lip portion of uniform thickness extending snugly over at least a part of that portion of said uppermost surface of the marker adjacent to said side surface, and a wall portion extending downward from said lip portion, said wall portion extending over at least a part of said side surface, said wall portion defining an opening about at least one existing reflective portion of said side surface, and a base portion extending outward from said wall portion, said base portion extending contiguously about at least a part of said wall portion, said base portion comprising, in order to make better use of the adhesive used for securement, at least one of an uneven underside and an uneven periphery and a uniform width of said base portion beyond said wall portion.

2. A raised pavement marker brace according to claim 1, and further including:

a top portion extending inward from and along at least a part of said lip portion, said top portion extending only upon those parts of said uppermost surface likely to degrade comparatively quickly from vehicle-tire and other types of impact.

3. A raised pavement marker brace according to claim 1, wherein:

said wall portion resembles a hollow frustum, said hollow frustum defines sufficient space between said wall portion and said side surface for the extension upward into such space of a ridge of adhesive for improved retention of the brace against movement relative to the pavement.

4. A raised pavement marker brace according to claim 3, and further including:

a top portion extending inward and along at least a part of said lip portion, said top portion extending only upon those parts of said uppermost surface likely to degrade comparatively quickly from vehicle-tire and other types of impact.

5. A raised pavement marker brace according to claim 1, wherein: said wall portion resembles a hollow frustum said hollow frustum defines sufficient space between said wall portion and said side surface for the extension upward into such space of a ridge of adhesive for improved retention of the brace against movement relative to the pavement.

6. A raised pavement marker brace according to claim 5, and further including:

a top portion extending inward from and along at least a part of said lip portion, said top portion extending only upon those parts of said uppermost surface likely to degrade comparatively quickly from vehicle-tire and other types of impact.

7. A raised pavement marker brace configured and adapted to extend about a wholly stationary raised pavement marker having an uppermost surface and at least one side surface, said brace inseparably comprising a retaining lip portion of uniform thickness extending snugly over at least a part of that portion of said uppermost surface of the marker adjacent to said side surface, and a wall portion extending downward from said lip portion, said wall portion extending over at least a part of said side surface, said wall portion defining an opening about at least one existing reflective portion of said side surface, and a base portion extending outward from said wall portion, said base portion extending contiguously about at least a part of said wall portion, said base portion comprising, in order to make better use of the adhesive used for securement, at least one of an uneven underside and an uneven periphery and a uniform width of said base portion beyond said wall portion, and at least one of said wall portion and said base portion defining a plurality of openings for extension therethrough of said adhesive during application thereof to define and provide adhesive portions extending from said openings onto at least one of an outer surface of said wall portion or an upper side of said base portion for better retention of the brace against movement relative to the pavement.

8. A raised pavement marker brace according to claim 7, and further including:

a top portion extending inward and along at least a part of said lip portion, said top portion extending only upon those parts of said uppermost surface likely to degrade comparatively quickly from vehicle-tire and other types of impact.

* * * * *